United States Patent [19]

Danforth

[11] 3,946,951

[45] Mar. 30, 1976

[54] ATTRITION PULPER HAVING HIGH LEVEL THRUST FOR GRINDING PULP AND REFINING FIBRES

[75] Inventor: Donald W. Danforth, Andover, Mass.

[73] Assignee: Bolton-Emerson, Inc., Lawrence, Mass.

[22] Filed: June 21, 1974

[21] Appl. No.: 481,491

[52] U.S. Cl. ..... 241/21; 241/28

[51] Int. Cl.[2] ..... B02C 23/26

[58] Field of Search ..... 241/21, 28, 37, 46.11, 241/46.17

[56] References Cited

UNITED STATES PATENTS

| | | | |
|---|---|---|---|
| 2,596,586 | 5/1952 | Morden | 241/261.2 |
| 2,685,826 | 8/1954 | Black | 241/46 R |
| 3,073,535 | 1/1963 | Vokes | 241/46.11 |
| 3,428,261 | 2/1969 | Moulton | 241/21 |

*Primary Examiner*—Granville Y. Custer, Jr.

*Attorney, Agent, or Firm*—Pearson & Pearson

[57] ABSTRACT

A vortical circulation type pulper has a bladed rotor and stator with a fixed clearance and operates at conventional horsepower to defibre conventional pulp, capable of being defibered, until the fibres are separated. With unconventional pulp, hemp, flax, rags, leather, and certain rejects, which cannot be so defibered, the rotor of the pulper of this invention is advanced to zero clearance and the horsepower increased about fifty percent, the resultant thrust grinding the mass of pulp, and then fibrillating the fibres in the pulper to a desired degree of refining. The rotor then backs off and the refined pulp is dumped from the pulper. An automatic freeness tester senses the condition of the pulp and actuates the electric control circuit.

2 Claims, 10 Drawing Figures

Fig. 4.
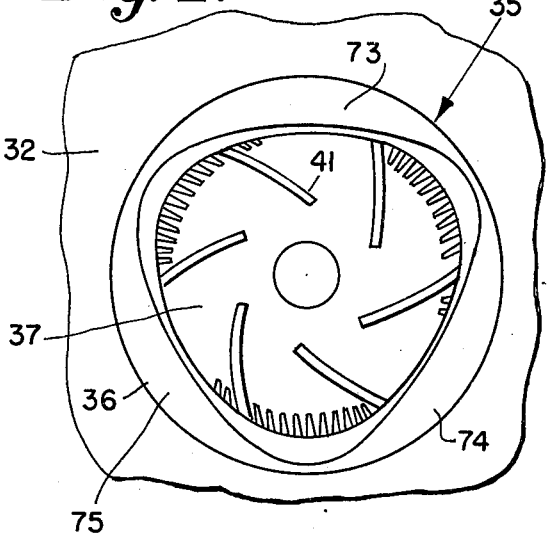
Fig. 5.
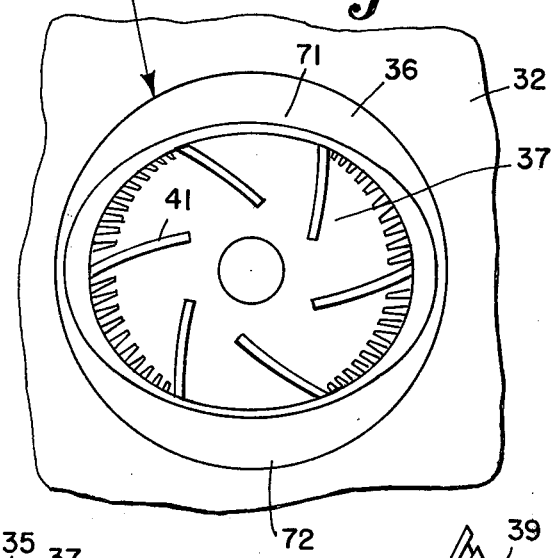
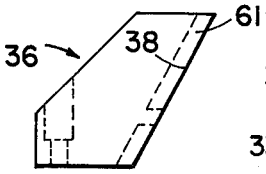
Fig. 6A
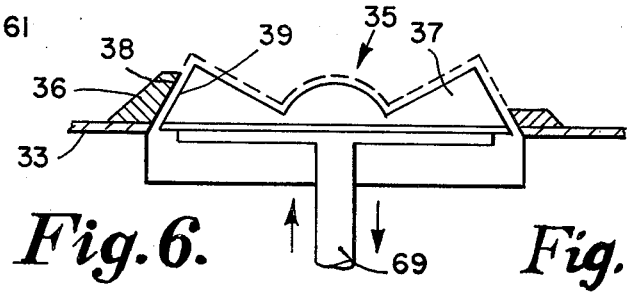
Fig. 6.
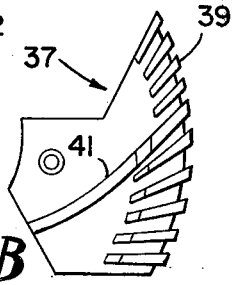
Fig. 6B
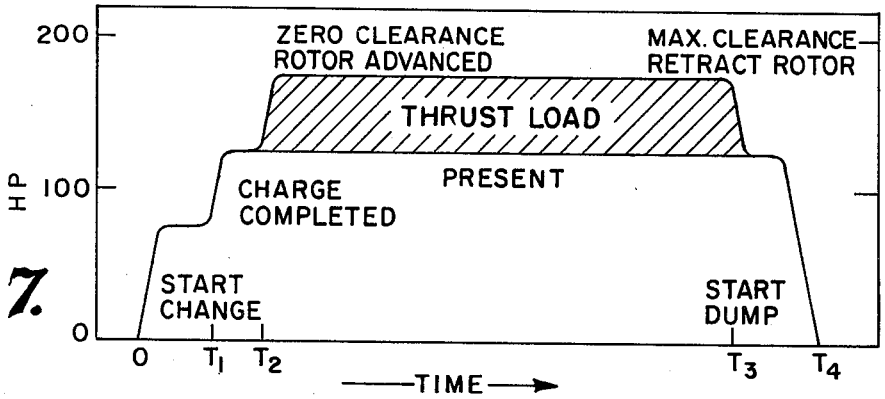
Fig. 7.
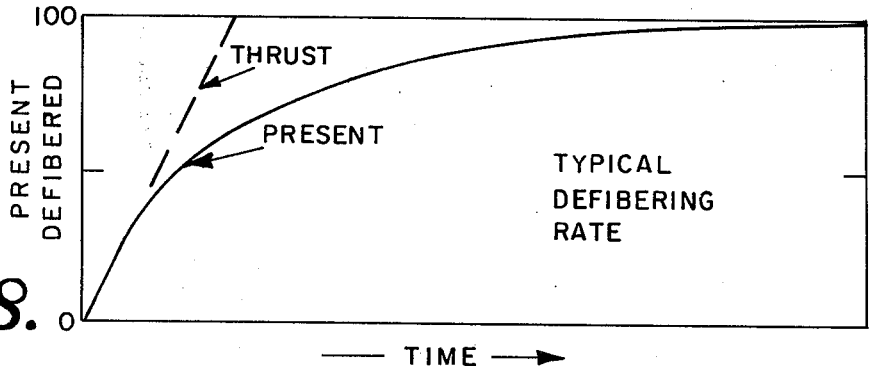
Fig. 8.

ATTRITION PULPER HAVING HIGH LEVEL THRUST FOR GRINDING PULP AND REFINING FIBRES

BACKGROUND OF THE INVENTION

In the papermaking process, a pulper is the device employed to convert cellulose materials into a defibered water slurry capable of being pumped to subsequent operations. Various types of pulpers have been developed, originating with a simple, open rotor revolving in an open top cylindrical tank. By providing a stationary bladed element with which the rotor blades can cooperate, additional defibering capability can be developed, thereby improving overall efficiency. With an open rotor, there is a limit to the amount of power (which ultimately is a function of rotor diameter, number and height of rotor blades, and RPM) which can be accommodated without creating an excessive vortex. By providing a stationary bladed element essentially surrounding the rotor, additional power can be accommodated, without causing unnecessary circulation, thereby transforming this additional power into useful energy.

However, operating at a fixed rotor/stator clearance, there is ultimately a limit to the amount of defibering (and the amount of fibre treatment) which can be accomplished in this manner. By providing for axial movement of the rotor with respect to stator, clearance can be adjusted and, in fact, reduced to essentially zero to effect more positive fibre separation. Beyond, however, mere defibering, it is possible to actually refine (i.e., cut and fibrillate fibres) by applying suitable thrust between rotor and stator surfaces. By requiring the fibres to pass between the rotor and stator under substantial thrust, a significant refining action can be produced which has a remarkable effect and not only completely defibres otherwise difficult-to-defibre materials, but actually contriutes to refining of the fibres themselves such that the slurry is in a condition whereby it can be pumped easily to subsequent operations.

Such treatment has been found to be required in the processing of unconventional material such as leather, certain tough rejects, hemp, flax, rags, and other materials. Because of the characteristic stringy, tangled nature of such materials, reduction to pumpable form has traditionally been carried out in beaters which, though effective, incur high labor, maintenance and energy costs. When processed in conventional pulpers, such materials not only resist reduction but they are impossible to defibre inasmuch as the action between bladed rotor and stator (at fixed clearance) is insufficient to break down the mass into a suitably defibered condition. Refiners on the other hand, can refine such material only if it has been suitably pre-treated and thus reduced in size so that it can be accommodated by the refiners.

The purpose of the present invention is to literally combine these two normally independent actions into one unit so as to, in effect, refine in the pulper. This can be accomplished by constructing a pulper rotor/stator combination such that the rotor is capable of axial adjustment to provide required thrust in a manner similar to a conical refiner. Necessarily, sufficient horsepower must be connected to permit delivery of required force. The mass of unconventional material is subjected to a grinding action which reduces the mass to a condition in which it can enter the interface and be further defibered and refined. Such a method will not only permit for positive separation of fibres, but will actually enable physical transformation of the fibres so as to provide fibre pre-treatment.

Prior art pulpers have not been able to cope with the unconventional materials specified above because they would never be defibered enough to be pumped out of the container and are so tough intrinsically, so tangled and interwoven as to form into a mass that will not yield to anything short of substantial thrust between rotor and stator edges in the manner of shears. Such a mass cannot be pulled apart by the hydraulic shearing affect of a conventional pulper, anymore than the tangled mass could be cut with a pair of loose, dull scissor blades. It needs grinding and shearing to permit further treatment.

THE PRIOR ART

To understand how this invention improves over the teachings of the prior art, one must know the meaning of terms used, and sometimes misused, in certain patents.

In the patents mentioned hereafter, the words attrition, defibering and refining are all used. It should be kept in mind, however, that the pulpers described therein may be capable of attrition, defibering or separation of fibre bundles into individual fibres, but if clearance remains fixed and horsepower remains constant, no refining or development of fibres will occur even if the patentee uses the term "refining".

In the U.S. Pat. No. 2,596,586 to Morden of May 13, 1932, a pulper is disclosed in which a disc-type rotor and ring-like stator have attritioning surfaces which are stated to be capable of refining action. However, no means for increasing the horsepower while decreasing the clearance is mentioned in the patent, these being essential for refining.

Similarly, references are made to beating and splitting the fibres in U.S. Pat. No. 2,685,826 to Black of Aug. 10, 1954, by manually reducing the clearance between the bars, but no disclosure is made of the increasing of horsepower necessary to provide the thrust required to refine fibres and no mention is made of the required zero clearance.

In the U.S. Pat. No. 3,428,261 to Moulton of Feb. 18, 1969, a pulping rotor in the bottom of a tank is provided with power means for adjusting clearance of the attrition faces. The attrition effect of the pulper may thus be automatically changed, but there is no teaching of either zero clearance or means for applying sufficient increase of horsepower to actually refine and fibrillate the fibres.

It is believed that if one introduced rags, hemp, flax, leather, certain rejects, or the like into any of the pulpers of the above patents, or any other known pulper, the material would dewater, mat and plug up at the interface. If it was sought to dump, the material would plug the pump and the dump valve. Eventually, gobs of the material would have to be removed with grappling hooks.

No prior art pulper is thought to be capable of handling such materials which have never been defibered and which still have natural forces holding the fibres together so strongly that a conventional pulper cannot cope with them.

None teach the high thrust, zero clearance, actual grinding effect of this invention, required to permit further treatment of the material.

SUMMARY OF THE INVENTION

In this invention, the bladed rotor and bladed stator are located in the bottom, or side, of a pulper tank and the rotor is provided with manual or power means for axial adjustment of the clearance of the attrition face, as in the above mentioned patents. Thus, the device is capable of pulping, defibering and attrition.

However, the apparatus of the invention also includes means for setting the blades at zero clearance and means for increasing the horsepower sufficiently to drive the bladed rotor so that it actually exerts a grinding action on the material while also it fibrillates or refines the defibered fibres to a desired degree of refinement. In addition, sensing devices are included which are responsive to predetermined degrees of freeness, or other factors, so that the powered actuation of the rotor adjustment is automatic in advancing to zero clearance and backing off when refining is complete.

BRIEF DESCRIPTION OF THE DRAWING

FIG. 4 is a fragmentary side elevation of a side drive pulper having a bladed rotor and three lobed stator or shroud therearound.

FIG. 5 is a view similar to FIG. 4 showing a double, opposed lobular shroud.

FIG. 6 is a diagrammatic side elevation of a typical side, or bottom, drive bladed and channeled rotor and stator showing the range of clearance at the attrition face from zero to conventional, FIG. 6A being an enlarged side elevation of a bladed and channeled stator and FIG. 6B being a plan view enlarged of a bladed and channeled rotor segment.

FIG. 7 is a graph showing the application of the increased horsepower and resulting thrust load required to refine the fibres which have been defibered in the container.

FIG. 8 is a graph showing the typical defibering rate of conventional prior art pulpers and the effect thereon of the increased thrust taught herein.

DESCRIPTION OF A PREFERRED EMBODIMENT

Figure 1:
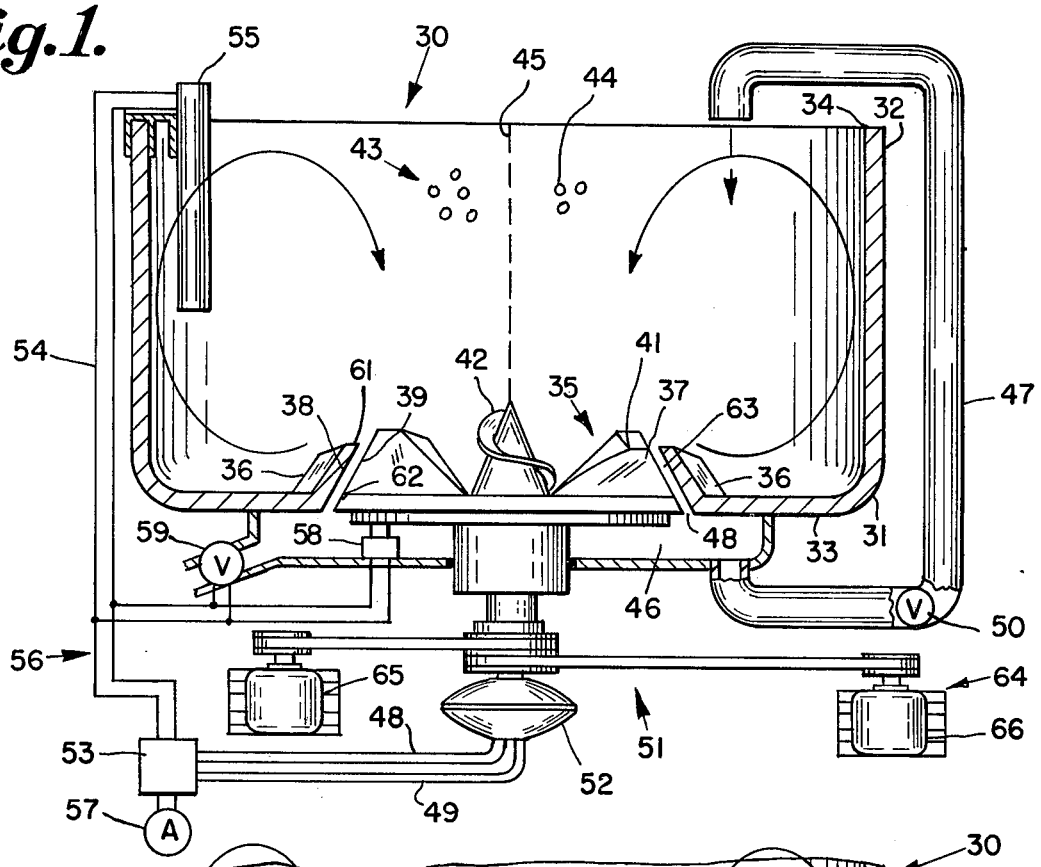
FIG. 1 is a side elevation of a typical side drive or bottom drive vortical circulation type pulper showing the apparatus of the invention arranged for the defibering step of the method.

In the drawings, a typical vortical circulation pulper 30 is shown, such as described in detail in U.S. Pat. No. 3,428,261 to Moulton of Feb. 18, 1969, and owned by a common assignee. The pulper of U.S. Pat. No. 3,428,261 is commercially available from Bolton-Emerson, Inc., of Lawrence, Massachusetts, in side drive form under the designation "Tornado" and is so well known in the trade as to not require description in detail. In general, however, pulper 30 includes the pulp container 31 having an upstanding side wall 32 and bottom wall 33, upper rim 34 and attrition means 35 consisting of the bladed and channeled stator 36 and bladed and channeled rotor 37, each having a truncated conical attrition face 38 and 39 tending to pump stock outwardly away from the centre of the container. Suitable circulation vanes 41 are provided on rotor 37 which cooperate with the helix 42 to create vortical circulation of the charge 43 of paper stock 44, desired to be pulped and defibered, the means 35 tending to draw the material inwardly along the axis 45 of the container, then to pump it outwardly either peripherally up the side of the container and back into the centre or to drive the material outwardly into the collection chamber 46 through conduit 47, control valve 50 and back into the container, all in a known manner.

In the pulper shown, the attrition means 35 is mounted in an opening 48 in the bottom wall 33, but it is equally effective when mounted in an opening in side wall 32, as shown in FIGS. 4, 5 and 6.

Clearance adjustment means 51 may include shims for varying the position of stator 36 and may include a manually operable threaded thrust screw mechanism for axially moving the truncated conical rotor, or impellor, 37 toward and away from the truncated conical stator to increase and decrease clearance. Preferably, however, clearance adjustment means 51 comprises a pneumatic actuator 52 supplied with pressurized air on both sides of the diaphragm by air tubes 48 and 49 thereof, to automatically advance and retract the rotor, while the rotor is revolving. The pressurized air is supplied by suitable connection with factory air to maintain the rotor in a desired axial position, at a predetermined clearance, or to advance or retract the same, in accordance with an automatic cycle control 53 including conductors 54 and a freeness tester 55, such as the "Drainac" made by Bolton-Emerson, Inc., of Lawrence, Mass., or some other sensing device responsive to the characteristics of the paper stock in the container 31. The electric control circuit 56 includes an ammeter 57 for visual observation by an operator and a limit switch 58 actuated upon full retraction of the rotor to open the discharge or dumping valve 59 to empty the container 31 of its fully defibered and refined contents.

The small diameter end 61 of the attrition faces 38, and 39 is closer to the centre of the pulper than the large diameter end 62 thereof and the attrition face 38 of the stator is preferably imperforate to serve as a pump housing and there may be dams in the channels of the attrition faces to positively guide the stock across the interface 63.

The thrust means 64 of the invention includes the drive motor 65 which, in the conventional pulper of the prior art, is capable of drawing about 125 horsepower at the conventional fixed clearance of the attrition faces of about 0.025 inch, this being sufficient to adequately defibre for example a charge of waste paper. As shown in FIG. 7, the so-called attrition pulper calls for the power demand shown when only water is present in container 31. When the material to be defibered is introduced into the water in container 31, power demand increases to the level shown, namely about 125 horsepower, and remains at that level until the material is pulped, defibered and ready for discharge to the next treatment, which is usually refining.

Figure 2:
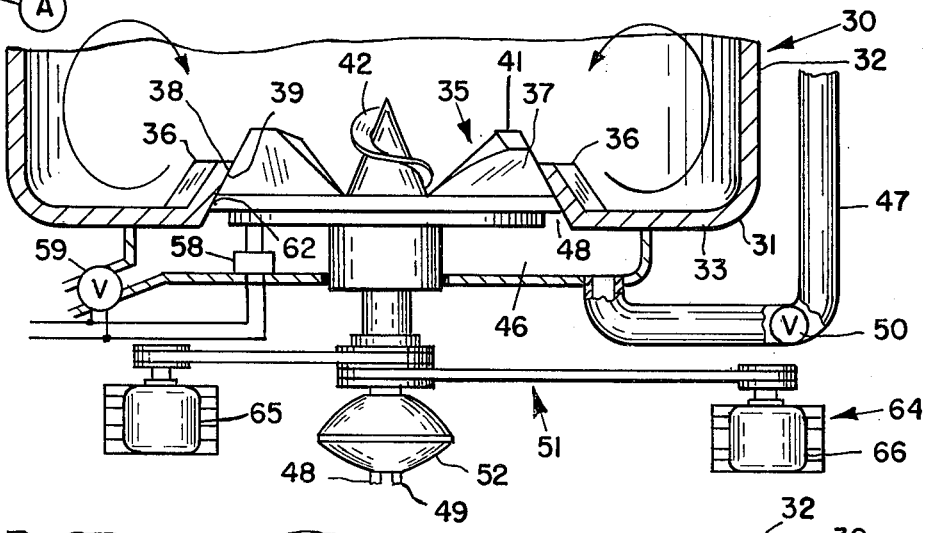
FIG. 2 is a view similar to FIG. 1 showing the apparatus of the invention arranged for the grinding and refining step at zero clearance and greatly increased horsepower consumption and thrust.
Figure 3:
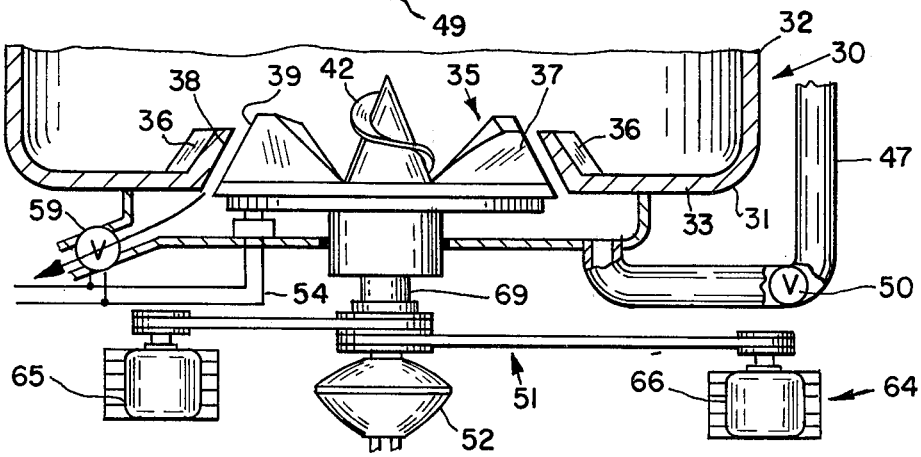
FIG. 3 is a view similar to FIG. 1 showing the apparatus of the invention arranged for the back-off, increased clearance stock discharge, or dumping step.

In this invention, when the charge 43 of unconventional material is so pulped and defibered, ready for dumping, or preferably simultaneously with such defibering, the rotor 37 is automatically advanced by actuator 52 to zero clearance (FIG. 2) in the manner of a conical refiner to develop the desired thrust. A separate motor 66 may be provided to supplement the motor 65 in driving the rotor at zero clearance to draw the 180 to 200 horsepower shown for grinding the unconventional material, then refining and fibrillating the fibres. Material intercepted between rotor and stator blades is thus converted to flowable condition by grinding action and simultaneously subjected to very substantial thrust forces by which it is sheared, defibered and refined. The amount of thrust is adjustable depending upon the type of material and the treatment desired. The term grinding is meant to include cutting, breaking, chopping, shearing, abrading, etc. as compared to the rubbing, friction wearing or weakening caused by slow attrition.

ILLUSTRATIONS

By "grinding effect" is meant the reducing of the mass, or aggregates, to discrete elements rapidly under high thrust until in flowable condition, so that further defibering and refining may take place, the grinding, defibering and refining ocurring simultaneously due to the heterogenous nature of the batch process.

As will be apparent from the following illustrations, utilizing unconventional material highly resistant to pulping, the apparatus and method of this invention first provides a stator properly shaped to enable acquisition of the material, a rotor having sufficient thrust and correct clearance to enable grinding as well as defibering; and recirculation to enable homogenization for enabling the entire mass of material to be quickly and efficiently defibered and at least partially refined.

To illustrate, utilizing cooked hemp, with the normal 0.025 inch clearance between rotor and stator, after 30 minutes of operation stock was in a completely unacceptable (in fact, unpumpable) condition; however, by developing thrust so as to draw 170 horsepower (in contrast to the normal 125 horsepower), at the end of thirty minutes of treatment, the stock was completely defibered, entirely suitable for subsequent treatment; in fact, additional processing in the pulper in this manner produces significant fibre treatment reducing subsequent refining requirements. Another illustration involves cooked cotton (mailbag) rags which are highly resistant to standard pulper treatment but which, nevertheless, yield to the type of operation described; specifically, increasing thrust load to 200 horsepower resulted in completely acceptable stock in thirty minutes and increasingly refined stock with increasing time.

In summary, this distinctly different fibre treatment method permits for the delivery of substantially more power in a manner which is vastly more effective than is possible in a conventional pulper thereby permitting treatment with materials heretofore considered completely impractical for pulpers. It appears that this concept offers very considerable implications inasmuch as it portends the elimination of beaters which, in spite of high costs normally associated, have, nevertheless, been the only practical means by which such materials could be accommodated.

The stator design in this invention differs from conventional attrition pulpers, as now made, which usually have only one lobe. If, as taught herein, the rotor is advanced to generate thrust, a single or asymmetric lobe arrangement produces substantial deflection forces on the rotor shaft 69. As shown in FIGS. 4 and 5, however, by providing two oppositely disposed lobes 71 and 72, or three equi-spaced lobes 73, 74 and 75, the deflection forces are balanced and considerable thrust may be absorbed with no shaft deflection.

The ammeter 57 serves to indicate the measure of thrust developed. Because of the wear produced at zero clearance and thrust of 50 percent more than the normal of 125 horsepower, namely 170 to 200 horsepower, the attrition blades will require replacement and preferably are mounted on segmental plates for easy removal and replacement.

Instead of using a conventional 125 horsepower motor 65 with a supplemental motor 66, a single motor 65 may be used capable of developing 200 horsepower or more.

It should be noted that the truncated conical interface, formed by stator face 38 and rotor face 39, is relatively short to form a relatively narrow refining zone. Thus stringy, tangled, difficult to refine material tends to pass through the narrow refining zone before it has time to plug up.

In operation the rotor 32 is advanced to zero clearance with metal to metal contact of the rotor and stator blades. While one might think that the rotating part would freeze, or lock, against the non-rotating part or generate excessive heat, it has been found that this does not occur. Instead, the water and the fibres act as a lubricant and any heat is absorbed by the mix. Although the whole apparatus may deform, especially when the rotor is advanced beyond zero clearance under the vastly increased load and thrust, the only casualty is the possibility of excessive wear on the blades which is not fatal. Despite any such wear, which would normally be considered disadvantageous by engineers skilled in the art, the difficult to refine material becomes fibrillated as desired which is the objective. The blades are readily replaced when needed.

I claim:

1. The method of treating unconventional pulp in a vortical circulation pulper having a bladed and channeled stator and rotor with a fixed interface clearance, the rotor driven at a predetermined horsepower and the pulp being recirculated by the pumping action at said interface, which comprises the steps of:

charging said pulper with unconventional pulp; such as, flax, hemp, rags, leather or the like;

then advancing said rotor to zero clearance, increasing said horsepower at least fifty percent to achieve sufficient thrust and exerting a grinding action to refine and develop the fibres in such unconventional pulp, in a predetermined time;

then automatically sensing that said fibres have been refined to a predetermined standard;

and then backing off said rotor and discharging said refined pulp from said pulper.

2. The method of pulping and refining fibres in unconventional material; such as, hamp, flax, rags and leather by means of a pulp container having a bladed stator and rotor with a truncated conical attrition face and having means for advancing said rotor axially toward said stator, said method comprising the steps of:

charging said container with such material;

rotating said rotor at zero clearance and applying increased thrust thereto sufficient to exert a grinding action to fibrillate and refine said fibres while still in said container; and then retracting said rotor from said stator and discharging said refined fibres from said container.

* * * * *